US005399037A

United States Patent [19]

Storlie

[11] Patent Number: 5,399,037

[45] Date of Patent: Mar. 21, 1995

[54] FORCE TRANSFERRING MAGNETIC ACTUATOR APPARATUS AND METHOD

[75] Inventor: Chris A. Storlie, Boise, Id.

[73] Assignee: Hewlett-Packard Company, Palo Alto, Calif.

[21] Appl. No.: 84,378

[22] Filed: Jun. 29, 1993

[51] Int. Cl.[6] ..... B41J 19/80

[52] U.S. Cl. ..... 400/572; 400/574; 355/212; 355/237

[58] Field of Search ..... 335/237, 220, 212; 400/572, 573, 573.1, 574, 574.1, 575

[56] References Cited

U.S. PATENT DOCUMENTS

| | | | |
|---|---|---|---|
| 2,814,764 | 1/1955 | De Fligue et al. | 335/320 |
| 3,271,707 | 9/1966 | Koehler | 335/320 |
| 4,895,463 | 1/1990 | Wysk | 335/237 |
| 4,934,848 | 6/1990 | Hayashi et al. | 335/237 |

FOREIGN PATENT DOCUMENTS

| | | | |
|---|---|---|---|
| 0108178 | 6/1983 | Japan | 400/575.2 |
| 0101383 | 6/1984 | Japan | 400/572 |

*Primary Examiner*—Edgar S. Burr
*Assistant Examiner*—John S. Hilten

[57] ABSTRACT

A magnetic actuator apparatus which transfers a magnetic force produced by a solenoid to a movable arm. The arm is movable between an engaged position spaced away from the solenoid and a solenoid position abutting the solenoid. The arm has a bore formed therein opposite the solenoid. A magnetic member is slidingly received in the bore. The magnetic member is spaced away from the solenoid a distance less than the arm when the arm is in the engaged position and abuts the solenoid when the arm is in the solenoid position. A head is connected to the magnetic member on the side of the arm opposite the solenoid to prevent the magnetic member from passing through the bore. The head transfers the force applied to the magnetic member to the arm when the solenoid is energized. The arm and the magnetic member move in unison until the magnetic member abuts the solenoid at which point the arm moves relative to the magnetic member until the arm reaches the solenoid position.

18 Claims, 6 Drawing Sheets

FORCE TRANSFERRING MAGNETIC ACTUATOR APPARATUS AND METHOD

BACKGROUND OF THE INVENTION

This invention relates generally to actuation systems and more particularly to magnetic actuation systems in printers.

Actuation systems using magnetic actuators such as solenoids have long been employed in printers. A typical example of a system, indicated generally at 10, is shown in FIGS. 1A and 1B. The system 10 is used to selectively engage and disengage a pick arm 12 from a gear 14, as shown in FIGS. 1A and 1 B, respectively.

The system 10 is used, for example, to control a print media feed mechanism of a printer (not shown). When the pick arm 12 is engaged, the rotation of the gear 14 is inhibited, as shown in FIG. 1 A, and print media (not shown) is fed into a print media path, as is known in the art. However, when pick arm 12 is disengaged from gear 14, as shown in FIG. 1B, the gear rotates freely in a clockwise direction. This rotation stops the movement of the media through the print media path.

The pick arm 12 is selectively engaged and disengaged under the control of a solenoid 16. The solenoid 16 exerts an attractive magnetic force upon a magnetic arm 18, to which the pick arm 12 is attached at a distal end. The magnetic arm 18 is preferably a ferromagnetic material such as soft iron or steel but can also be a permanent magnet. The magnetic force opposes the force generated by a spring 20, which biases pick arm 12 into engagement with the gear 14, and the frictional force exerted by the gear 14 against a pick 22 when the pick 22 is engaged with the gear 14. If the magnetic force is strong enough, the pick arm 12 is disengaged from the gear 14 and the gear is permitted to rotate as shown in FIG. 1B. Once the pick arm 12 is disengaged, however, only a small amount of force is required to oppose the force generated by spring 20 and hold the arm 18 against solenoid 16.

Referring to FIG. 2, a plot 24 of force required to move the arm is plotted as a function of distance "X" as measured between the solenoid 16 and the arm 18, referred to as the "gap distance". Two positions are noted on the graph: an engagement position "$X_{ENG}$" wherein the pick 22 is engaged with the gear 14; and a solenoid position "$X_{SOL}$" wherein the pick 22 is disengaged from the gear 14 and adjacent to the solenoid 16. Superimposed on the graph is a plot 26 of the force exerted on the arm 18 by the solenoid as a function of distance X.

It is apparent from FIG. 2 that there is a mismatch between the force requirements to move the arm and the available force generated by the solenoid. The force required to move the arm is greatest when the pick is engaged at $X_{ENG}$. However, the force generated by the solenoid 16 is asymptotically approaching a minimum at this point. Thus, the force produced by the solenoid is inadequate to disengage the pick 22 from the gear 14. A similar but opposite disparity exists at $X_{SOL}$ where the pick 22 is disengaged from the gear 14 and the arm 18 is adjacent to the solenoid 16. The force required to hold the arm 18 in the solenoid position is minimal. However, the force generated by the solenoid is approaching its maximum.

In order to overcome this disparity, the solenoid must be sized large enough to generate a force $F_{ENG}$ sufficient to overcome the force required to disengage the pick 22 from the engaged position $X_{ENG}$. A graph 26' of the minimum requisite force is shown in FIG. 2. A solenoid necessary to generate this force, however, is more expensive, consumes more power and space, and generates more noise than a smaller solenoid. Moreover, the solenoid is excessive for holding the arm 18 in the solenoid position.

Accordingly, a need remains for a magnetic actuator system that more closely approximates the force requirements of the application. In addition, the actuator system should not consume any additional power than existing magnetic actuator systems.

SUMMARY OF THE INVENTION

It is, therefore, an object of the invention to provide a magnetic actuation system which more closely approximates the force requirements of the application.

A magnetic actuation apparatus is described which includes a solenoid for producing a magnetic force to move a movable arm away from an engaged position wherein the arm is spaced away from the solenoid to a solenoid position wherein the arm abuts the solenoid. A bore is formed in the arm opposite the solenoid to receive a magnetic member. The magnetic member is slidingly received in the bore and abuts the solenoid when the arm is in the solenoid position. A head is connected to the magnetic member on the side of the arm opposite the solenoid to preventing the magnetic member from passing through the bore. The head abuts the arm when the arm is in the engaged position and is spaced apart from the arm when the arm is in the solenoid position.

The magnetic member is positioned closer to the solenoid than the arm when the arm is in the engaged position. When the solenoid is energized a force is exerted upon the magnetic member. The head of the magnetic member then transfers the force to the arm. The force exerted on the arm thereby is sufficient to move the arm out of the engaged position. Once the magnetic member abuts the solenoid, the arm moves relative to the magnetic member until the arm is in the solenoid position.

The foregoing and other objects, features and advantages of the invention will become more readily apparent from the following detailed description of a preferred embodiment of the invention which proceeds with reference to the accompanying drawings.

DETAILED DESCRIPTION OF THE INVENTION

Figure 1A:
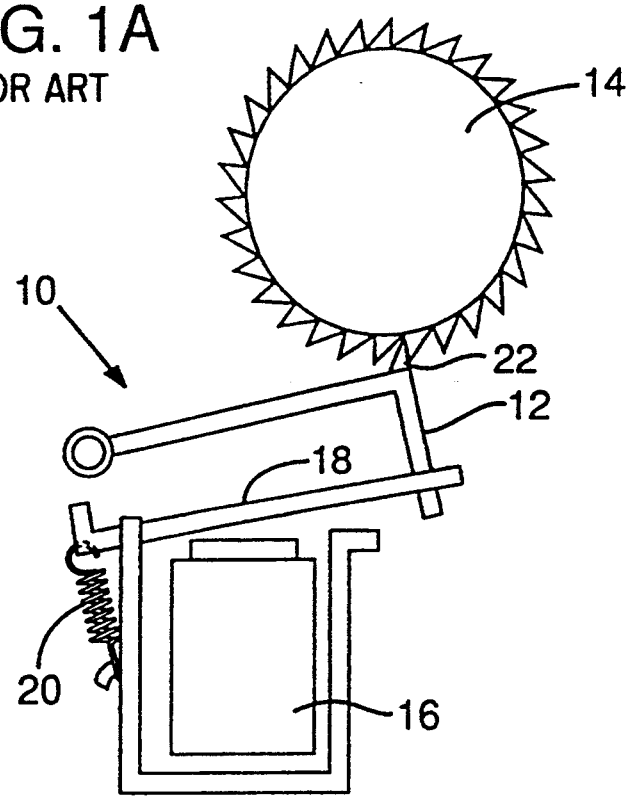
FIG. 1A PRIOR ART
FIG. 1A and 1B are schematics of a prior art embodiment of a magnetic actuator system for a paper feed mechanism in a printer.
Figure 1B:
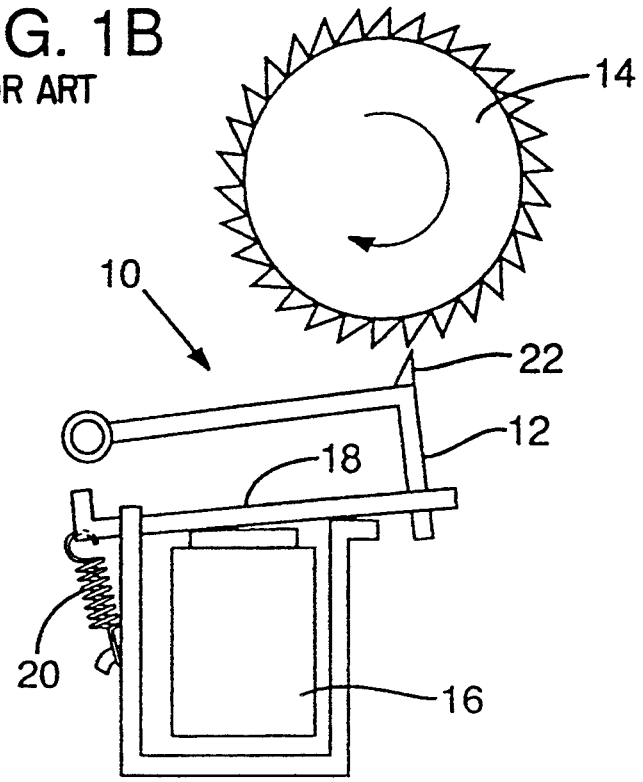
FIG. 1B PRIOR ART
Figure 2:
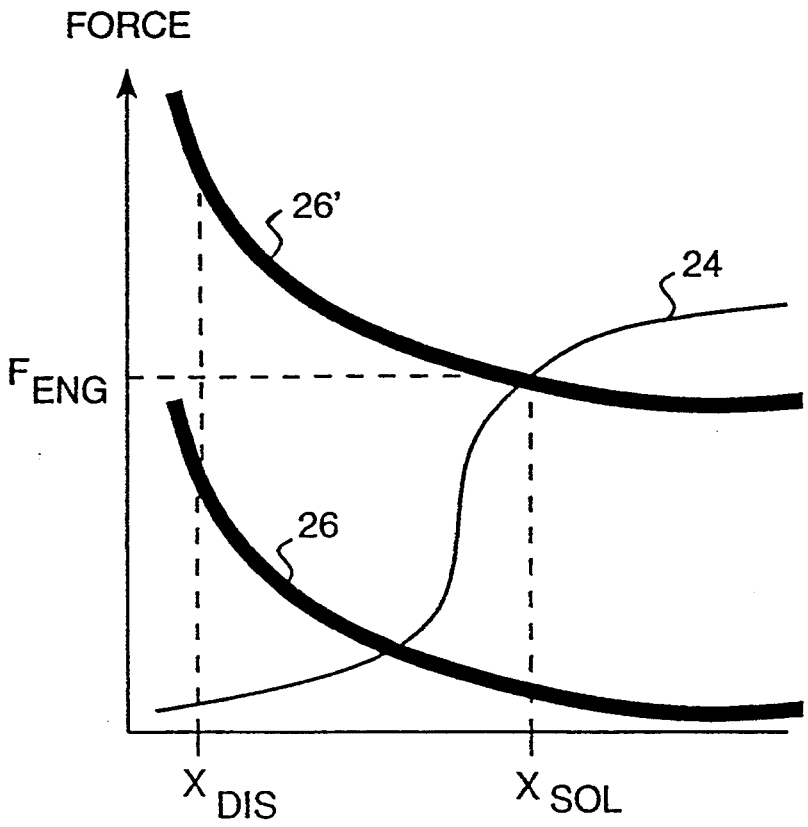
FIG. 2 is a graph of force curves plotted with respect to the separation from a solenoid.
Figure 3:
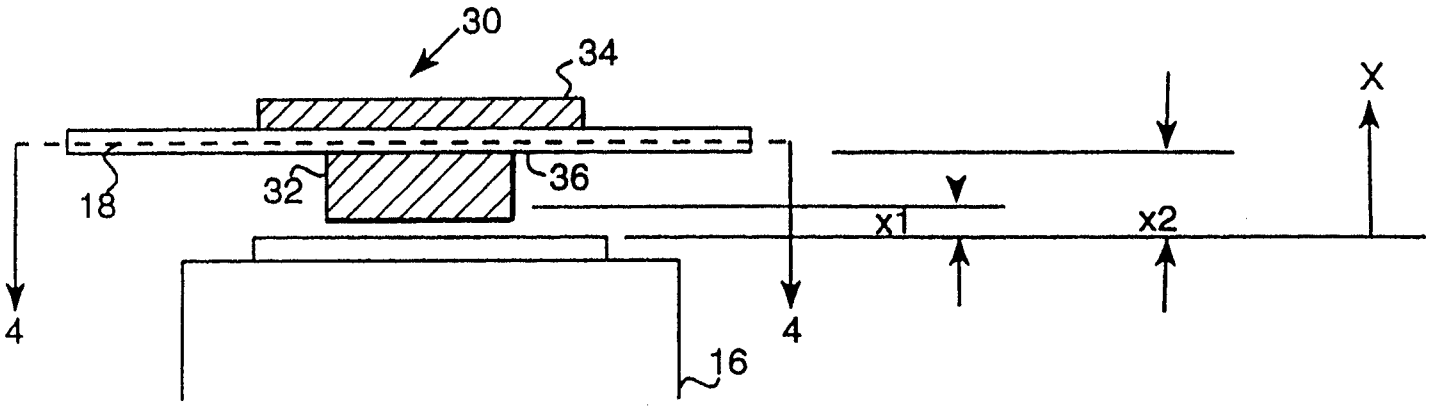
FIG. 3 is a sectional view of the magnetic actuator system according to the invention.

Referring now to FIG. 3, a magnetic actuator element 30 according to the invention is shown. The actuator element 30 includes a magnetic member 32 and a head 34. The magnetic member 32 is formed of a magnetic material, hence the name, in order for the solenoid 18 to exert an attractive force on the magnetic member 32. In the preferred embodiment, the magnetic member 32 is formed of a ferromagnetic material such as soft iron or steel, although the magnetic member 32 can be a permanent magnet. The head 34, on the other hand, can be formed of either magnetic or non-magnetic material. In the preferred embodiment, the head 34 is a plastic material. This eliminates any countervailing force on the arm 18 due to the head 34 when the arm 18 moves relative to the magnetic member 32, as described further below. The magnetic member 32 is slidably mounted in a bore 36 formed in the arm 18 of FIGS. 1A and 1B opposite the solenoid 16. The arm 18 can either be disposed for angular movement such as that shown in FIGS. 1A and 1B or, alternatively, disposed for linear movement toward and away from the solenoid 16.

The actuator element 30 is held in place by gravitational force. Alternatively, the element 30 could be slidably retained in the arm 18 by posts (not shown) formed on the arm 18 extending up through the head 34, or a flange (not shown) extending away from the arm 18 and over the head 34, or a housing (not shown). These or any equivalent means can be used to allow the arm 18 to move relative to the element 30 while preventing the element 30 from disengaging from the arm 18.

Figure 4:
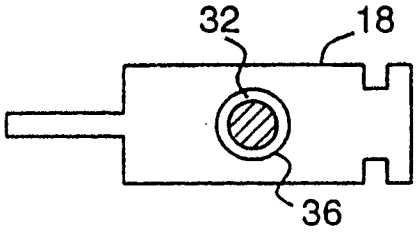
FIG. 4 is a cross-section view taken along 4—4 in FIG. 3.

The fitting between member 32 and bore 36 is shown in FIG. 4. In the preferred embodiment, the magnetic member 32 has a cylindrical shape and the bore 36 has a circular circumference which is slightly larger than the cross-section of member 32. The shape of the bore allows the member 32 to freely travel through the bore 36. The head 34 also has a circular circumference which extends beyond the circumference of the bore 36 to prevent the head 34 from entering the bore 36. Other shapes and sizes for the member 32 and the head 34 consistent with the inventive principle are possible.

In a first position, with the arm 18 separated from the solenoid, the magnetic member 32 extends beyond the arm 18 towards the solenoid 16. Thus, the displacement or "gap" separating the magnetic member 32 from the solenoid $X_1$ is less than the displacement between the arm 18 and the solenoid $X_2$. Therefore, the magnetic member 32 can be considered a "gap reducing member" which reduces the effective gap between the arm 18 to the solenoid 16 from $X_2$ to $X_1$. The significance of this reduced gap will become apparent in the operation section below.

OPERATION

Figure 5C:
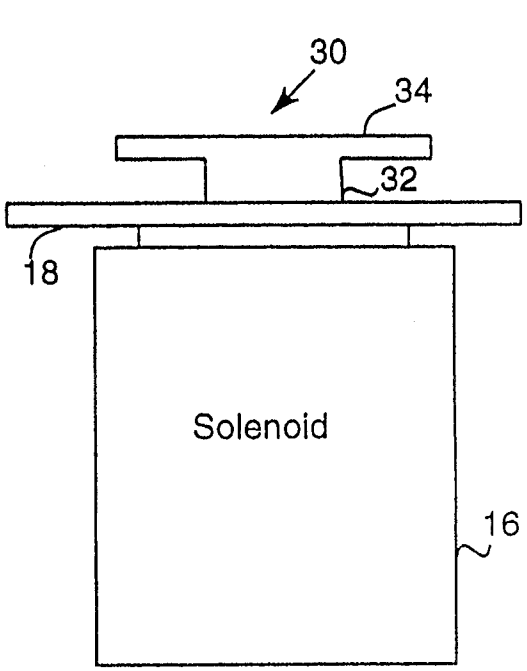
FIGS. 5A, 5B and 5C are schematics illustrating several distinct positions of the actuator element with respect to the solenoid.
Figure 5B:
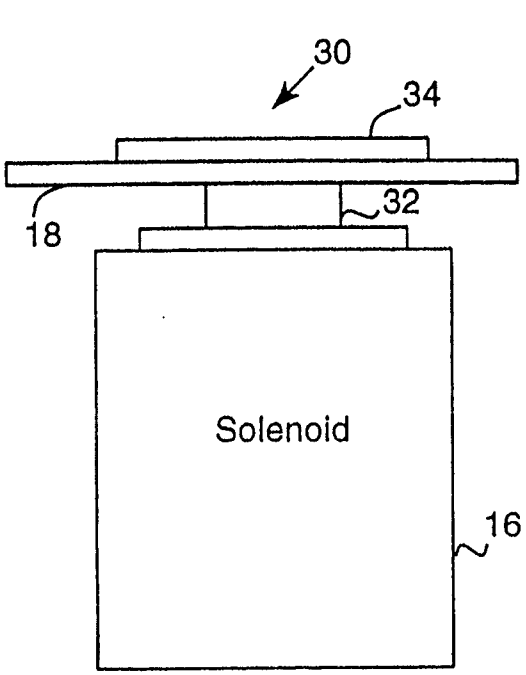
Figure 5A:
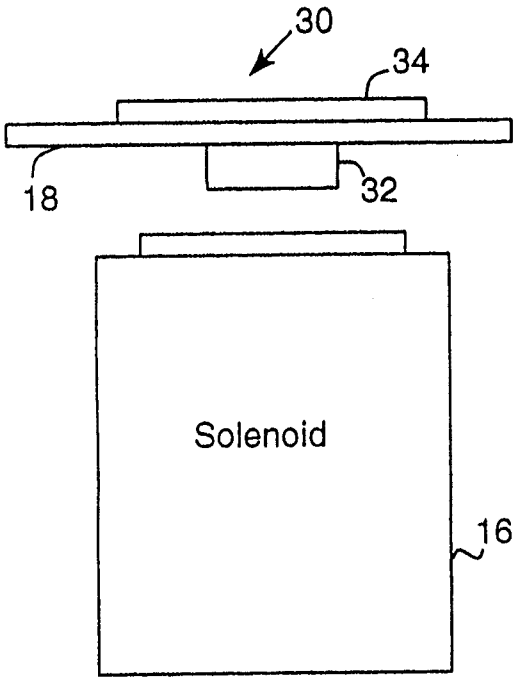

The operation of the actuator element 30 is shown in FIGS. 5A–5C. The operation of the actuator element 30 begins with the element 30 in a first position as shown in FIG. 5A. The first position corresponds to the engagement position of FIG. 1A wherein the arm 18 is engaged with the gear 14. The element 30 is slidably engaged in the bore 36 of the arm 18 as described above.

The solenoid 16 is then energized thereby producing a magnetic flux. The magnetic flux exerts an attractive force on both the arm 18 and the magnetic member 32. The amount of force exerted on the arm 18 and member 32 is a function of the distance to the solenoid 16 and the surface area. Since member 32 is positioned closer to the solenoid than the arm 18, a substantially greater force is exerted upon member 32 than the arm.

However, the force exerted upon the member 32 is transferred to the arm by the head 34. As the member 32 is pulled towards the solenoid, the head 34 exerts a downward force on the arm 18. The force is sufficient to disengage the arm 18 from the gear 14. The actuator element 30 and arm 18 move in unison until the member 32 abuts the solenoid 16, as shown in FIG. 5B. After the member 32 abuts against the solenoid 16, the force exerted on the arm by the solenoid 16 is sufficient to continue moving the arm 18 relative to the member 32 until the arm abuts the solenoid 16 in the solenoid position, as shown in FIG. 5C.

Figure 6:
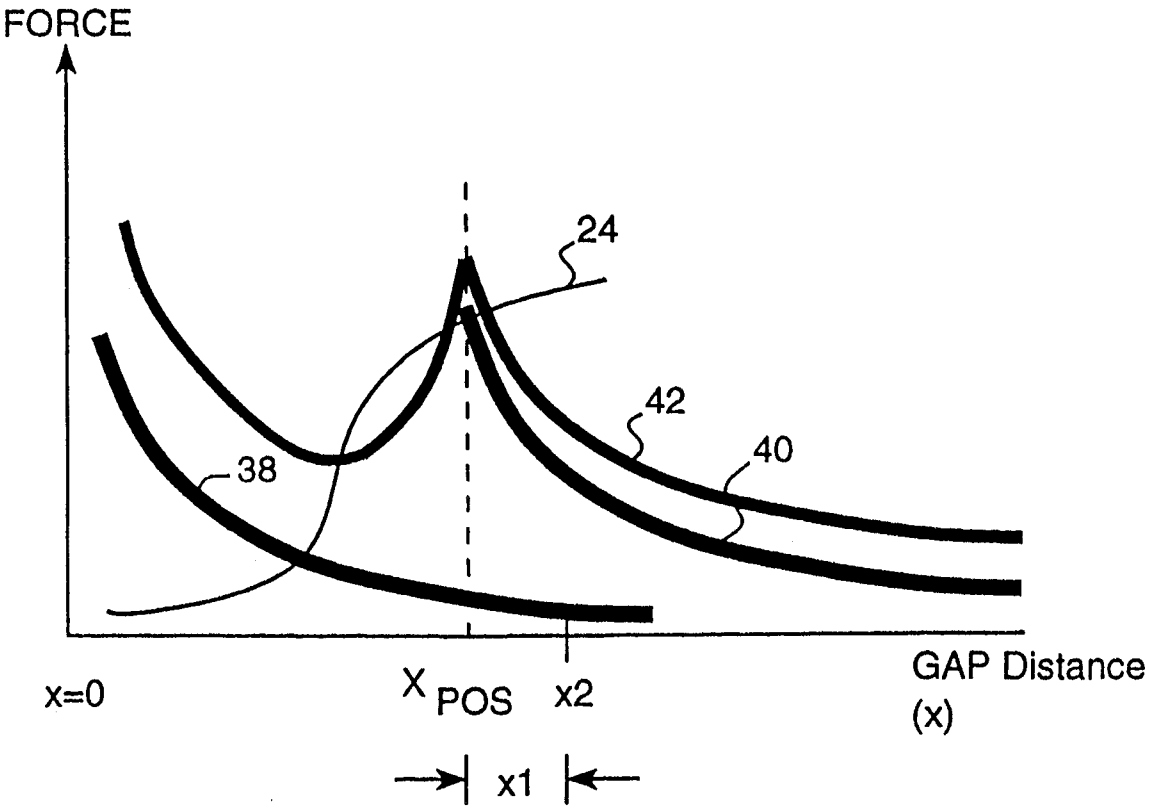
FIG. 6 is a graph of the force exerted against the arm plotted with respect to the separation from a solenoid.

Thus, the effect of the actuator element 30 is to exert a greater force on the arm when the solenoid is in the engaged position with the same size solenoid. Conceptually, the effect can be seen as the superposition of two force curves 38 and 40 as shown in FIG. 6. The first force curve 38 represents the force exerted on the arm by the solenoid 16. The second force curve 40 represents the force exerted on the member 32 by the solenoid 16. Since the second force is transferred to the arm by the head 34, the total force exerted on the arm 18 is represented by the sum of these forces as shown by force curve 42.

Figure 7:
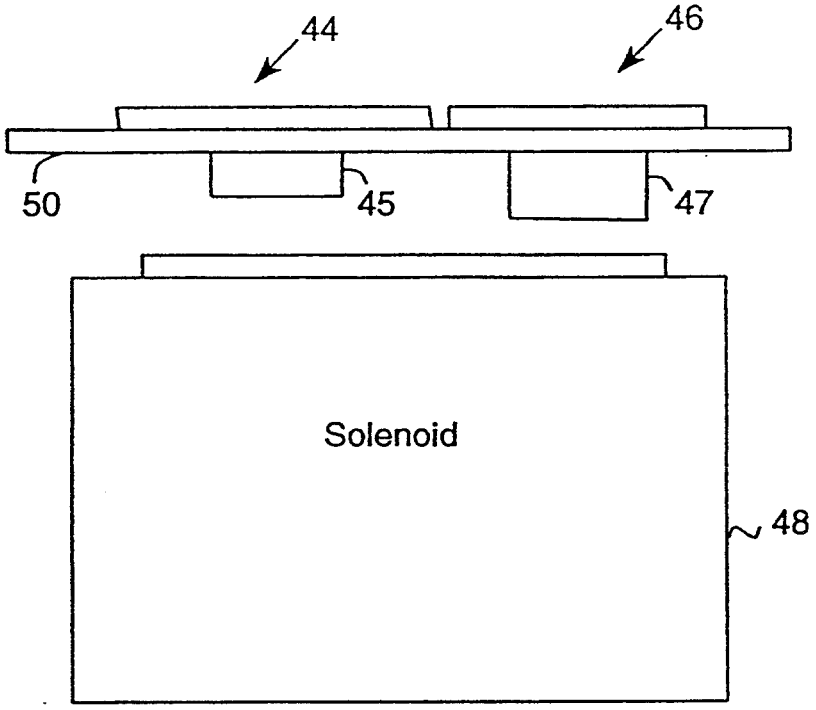
FIG. 7 is a schematic of an alternative embodiment of the invention employing two actuator elements.

The inventive principle can be extended in a variety of ways. The first is shown in FIG. 7. The embodiment of FIG. 7 includes two actuator elements 44 and 46 each having a different gap between the solenoid and their respective magnetic members 45 and 47. The force exerted by the solenoid is exerted upon members 45 and 47 and arm 50 in varying amounts depending on the separation from the solenoid 48 and their respective surface areas. This embodiment allows the force exerted on the arm 50 to be even better matched to the force requirements of the system is possible with only a single actuator element.

Figure 8:
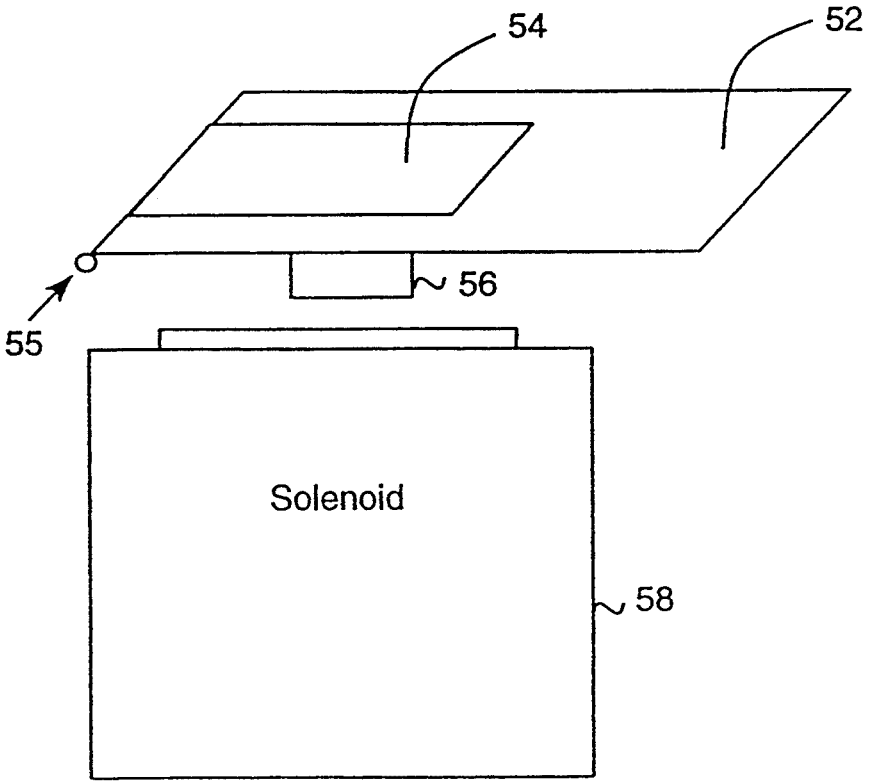
FIG. 8 is a schematic of yet another alternative embodiment of the invention.

Yet another embodiment of the invention is shown in FIG. 8. The embodiment of FIG. 8 includes an arm 52, and a rectangular head 54 both hingeally mounted at 55. Connected to head 54 is magnetic member 56 that is slidably mounted on a bore (not shown) formed in arm 52 opposite the solenoid 58. By hingeally mounting the arm 52 and the head 54 a smooth action transition between the engagement and solenoid positions. In addition, there is no opportunity for the member 56 to work free of the bore.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A magnetic actuation apparatus comprising:
a source for producing magnetic flux;
a magnetic arm having a top side and a bottom side disposed opposite said flux source for movement;
means for disposing the arm adjacent the flux source for movement between a first position spaced away from the flux source and a second position in which said arm bottom side abuts the source;
a gap reducing magnetic member slidable within the arm and disposed opposite the flux source at a displacement less than the distance between the first position and the second position when the arm is in the first position; and a force transferring member attached to the gap reducing member for transferring the force generated by the flux source from the gap reducing member to the top side of said arm.

2. A magnetic actuation apparatus according to claim 1 wherein the force transferring member is gravitationally forced against the top side of the arm.

3. A magnetic actuation apparatus according to claim 1 wherein the arm has a bore formed therein opposite the flux source and the gap reducing member is slidable within the bore.

4. A magnetic actuation apparatus according to claim 3 wherein the force transferring member comprises a head which extends beyond the bore to prevent the force transferring member from entering the bore.

5. A magnetic actuation apparatus according to claim 1 wherein the flux source comprises a solenoid.

6. A magnetic actuation apparatus according to claim 1 further comprising:

a second gap reducing magnetic member slidable within the arm and disposed opposite the flux source at a displacement less than the displacement of the gap reducing member; and a second force transferring member attached to the second gap reducing member and engaged with the arm for transferring the force generated by the flux source from the second gap reducing member to the arm.

7. A magnetic actuation apparatus comprising:

a solenoid;

an arm movable between a first position spaced away from the solenoid and a second position abutting the solenoid the arm having a side adjacent the solenoid and a side opposite the solenoid;

a bore formed in the arm opposite the solenoid;

a magnetic member slidingly received in the bore and abutting the solenoid when the arm is in the second position; and a head connected to the magnetic member on the side of the arm opposite the solenoid for preventing the magnetic member from passing through the bore, the head abutting the arm when the arm is in the first position and being spaced apart from the arm when the arm is in the second position.

8. A magnetic actuation apparatus according to claim 7 wherein the magnetic member and the arm are hingedly connected at a common point.

9. A magnetic actuation apparatus according to claim 7 wherein the magnetic member is a cylindrically shaped member and the bore has a circular circumference.

10. A magnetic actuation apparatus according to claim 7 wherein the magnetic member is formed of a ferromagnetic material.

11. A magnetic actuation apparatus according to claim 10 wherein the ferromagnetic material is soft steel.

12. A magnetic actuation apparatus according to claim 7 wherein the head is formed of plastic.

13. A magnetic actuation apparatus for a paper feed mechanism in a printer comprising:

a circular gear for engaging and disengaging the paper feed mechanism, the gear having teeth disposed around a perimeter of the gear, the gear being biased to rotate;

a source for producing magnetic flux;

a magnetic arm connected the printer for movement between an engaged position wherein the arm is engaged with the teeth of the gear and a disengaged position wherein the arm is disengaged from the teeth of the gear, the arm having a top side and a bottom side disposed opposite the flux source;

a gap reducing magnetic member slidable within the arm and disposed opposite the flux source at a displacement less than the distance between the engaged position and the disengaged position when the arm is in the engaged position; and a force transferring member attached to the gap reducing member for transferring the force generated by the flux source from the gap producing member to the arm.

14. A magnetic actuation apparatus according to claim 13 further comprising a pick engager connected to the arm for engaging the teeth of the gear.

15. A magnetic actuation apparatus according to claim 13 further comprising biasing means attached to the arm for normally biasing the arm into the engaged position.

16. A method of exerting a force produced by a magnetic flux source to a magnetic arm having a top side and a bottom side and disposed opposite the flux source, the method comprising:

slidably receiving a gap reducing member in the arm opposite the flux source at a displacement to the magnetic flux source that is less than the arm;

energizing the flux source such that a force is exerted on the gap reducing member;

transferring the force exerted on the gap reducing member to the arm; and moving the arm relative to the gap reducing member after the gap reducing member abuts against the flux source so that the arm abuts the flux source.

17. A method of exerting a force according to method 16 wherein engaging comprises:

forming a bore in the arm opposite the flux source for receiving the gap reducing member; and positioning the gap reducing; member in the bore.

18. A method of exerting a force according to method 16 wherein transferring the force comprises:

attaching a force transferring member to the gap reducing member on the top side the arm opposite the flux source; and transferring the force to the top side of the arm.

* * * * *